United States Patent [19]

Langlitz et al.

[11] Patent Number: 4,660,809

[45] Date of Patent: Apr. 28, 1987

[54] TILTABLE VESSEL

[75] Inventors: Karlheinz Langlitz, Muelheim; Guenter Schmitz, Duisburg, both of Fed. Rep. of Germany

[73] Assignee: Mannesmann AG, Duesseldorf, Fed. Rep. of Germany

[21] Appl. No.: 671,184

[22] Filed: Nov. 14, 1984

[30] Foreign Application Priority Data

Nov. 19, 1983 [DE] Fed. Rep. of Germany ..... 3341824

[51] Int. Cl.[4] ..... C21C 5/50

[52] U.S. Cl. ..... 266/246; 266/247

[58] Field of Search ..... 266/246, 243, 245, 247; 75/60

[56] References Cited

U.S. PATENT DOCUMENTS

| | | | |
|---|---|---|---|
| 3,376,029 | 4/1968 | Menu | 266/246 |
| 3,391,919 | 7/1968 | Eberhart | 266/246 |
| 3,684,265 | 8/1972 | Mähringer et al. | 266/246 |
| 4,280,688 | 7/1981 | Enkner et al. | 266/246 |

FOREIGN PATENT DOCUMENTS

| | | | |
|---|---|---|---|
| 0261416 | 8/1972 | U.S.S.R. | 266/246 |

OTHER PUBLICATIONS

*Webster's Third New International Dictionary*, p. 179, 5/21/62.

*Primary Examiner*—Melvyn J. Andrews
*Assistant Examiner*—S. Kastler
*Attorney, Agent, or Firm*—Ralf H. Siegemund

[57] ABSTRACT

A tilt mount for a metallurgical vessel having a carrier ring with tilt pins mounted and journaled in stationary bearings for tilting the vessel about a horizontal axis; there being means effective in the direction of a longitudinal axis of the vessel for mounting the vessel in the carrier ring, further comprising, a pair of oppositely positioned hollow bearings, means for mounting each of these bearings to the carrier ring in a locations opposite each other, including a pair of tension elements carrying respectively, on one end, the respective bearing and being with the respective other ends connected to the carrier ring.

9 Claims, 6 Drawing Figures

(A-A)

(B-B)

TILTABLE VESSEL

BACKGROUND OF THE INVENTION

The present invention relates to fastening hot vessels particularly tiltable metallurgical vessels such as a tiltable steel converter requiring accomodation of certain displacements or movements on account of a high thermal load. More particularly the invention relates to the fastening of a tiltable converter vessel, the weight of which is taken up in the case of a vertical position by means of tensioned bendable tension elements running parallel to the longitudinal center axis of the vessel, which tension elements are fastened to stationary or tiltable holding facilities; similar tension elements can be used in the case of a horizontal disposition of the vessel, and they will run transversely to the aforementioned longitudinal axis. Such a fastening facility may be usable for exchangable converter vessels wherein in particular the holder is tiltably mounted in tilt pins, the holder comprising a carrier frame being an open or closed carrier ring.

Fastening hot operated vessels in the above described manner is quite advantageous in practice because it is possible to combine in an optimum fashion two opposing technical demands and constraints. The head movement and displacement of the vessels under thermal load being basically positive as well as negative spatial thermal extensions, and a slack free mounting of the vessel on its holder can indeed be realized. Vessels generally to be considered are reactors, metallurgical vessels such as temporary storage vessels for molten metal or steel converter vessels. Any play or slag that may arise between the vessel and its holder can readily be compensated simply through a bias change of the above mentioned tension element. Such an adjustment is usually quite easy to be carried out.

A fastening arrangement of the type referred to above is shown for example in U.S. Pat. No. 3,684,265. This known construction solves the problem of maintaining the requisite force transmission in spite of the arising thermal displacement even if the gross weight i.e. weight of the converter vessel jacket with brick lining, amounts to about a thousand metric tons. Such a vessel can even be constructed in an exchangable fashion in spite of the rather large weight. There is, however, a significant problem, or one may say partial problem, arising from the need to remove the vessel from its holder within a relatively short period of time such as a few hours and to exchange for a new one. Nevertheless this is only a minor problem. The major problem is to reduce the thermal stress as it arises during long lasting continuous use of the vessel.

In accordance with the known proposal the bendable tension elements running parallel to the longitudinal axis of the vessel are provided for taking up forces which run parallel to that longitudinal axis. In a horizontal position of the vessel however these tension elements, still running in longitudinal direction in relation to the vessel, will transmit any weight only through the friction between vessel and holder which in fact means that only a small amount of the total weight is being transmitted in this case. Therefore for this particular disposition of the vessel one needs additional fastening means namely certain plug pins or bolts inside of the carrier ring and corresponding sockets or receivers for these pins are provided in a reenforcing ring. Such a system indeed facilitates exchanging the vessel to considerable extent because upon reuse the vessel can be oriented together with the reinforcing ring in relation to the plug pin, bearing in mind that the reinforcing ring is provided with plug pin receivers or sockets. This way then permits conducting an adjusting procedure in which the vessel is appropriately positioned and adjusted relatively easy and simply through driving and positioning the vehicle on which the vessel rides.

From a different point of view, however, one has to realize that this particular known system constitutes a rather rigid connection particularly in view of the inevitable thermal displacement of parts during long term operation and use. Thus, even though this arrangement is capable of carrying the vessel, the rigidity of the connection is difficult to reconcile with the requirement of permitting thermal extension. This difficulty can be traced to the arrangement wherein the plug pins are mounted to the carrier ring and the receiving sockets are mounted on the reinforcing ring of the vessel. The vessel, particularly its wall, will always have a higher temperature than the carrier ring or any different kind of holder. Therefore it cannot be excluded that different thermal extensions in fact shift the center axes of plug pin and plug pin receiver in relation to each other. Furthermore it cannot be completely excluded that the wall and socket joint in the known structure, particularly when taken in conjunction with center axes deviation as described, is no longer capable of fulfilling its function.

DESCRIPTION OF THE INVENTION

It is an object of the present invention to improve the holding of metallurgical vessels particularly in view of the special case of a horizontally tilted position which the vessel will assume in cases whereby particularly the fastening shall be provided so that any relative thermal displacement will not interfere with the fastening as such nor with the requisite requirement of taking up the load of the vessel in full, irrespective of a vertical or a horizontal or a intermediate tilt position. It is a particular object of the present invention to provide a tilt-mount for a metallurgical vessel there being a carrier ring for the vessel having tilt pins mounted in stationary bearings for tilting the vessel about a horizontal axis; the vessel itself being mounted to the carrier ring basically by mounting elements of vertical orientation such as tension rods or the like.

In accordance with the preferred embodiment of the present invention it is suggested to provide a pair of oppositely positioned hollow bearings and to mount each of these bearings to the carrier ring at an orientation of the respective hollow axes which is either vertical or horizontal but will not coincide with the tilt axis. A pair of short pins preferably of barrel shaped configuration are connected to the vessel and are inserted in the hollow bearings. In one particular configuration the hollow bearings each are mounted by a pair of transverse tension elements having their respective one end affixed and connected to the respective hollow bearing and with the respective other ends they are connected to and such as being suspended from the carrier ring. From a different aspect such an arrangement is disposed next to the vessel and the hollow bearings are oriented with axes parallel to the longitudinal axis of the metallurgical vessel. Moreover, they are axially displaced from the carrier ring with respect to the longitudinal axis of the vessel. In each instance corresponding short pins are mounted laterally off the metallurgical vessel and are inserted in the hollow bearings. This configuration permits ready removal of the vessel. Also relative displacement of vessel, mount and ring on account of thermal differential of the mounting of the hollow bearings is permitted even if the vessel is tilted to a horizontal position.

This particular arrangement simplifies considerably the known system of plug bolts or plug pins and plug receivers. Moreover a ball and socket mount is not needed because the tension elements provide the function of a ball and socket joint without the drawbacks of the latter. Moreover the hollow bearings are mounted as independent elements in a displaceable fashion permitting a high degree of temperature differentials to be taken up.

This mounting principle is generally extendable with a modification using an open or closed carrier ring in that within a plane perpendicular to the longitudinal axis of the vessel transverse tension elements provided above or below at the carrier ring for mounting the hollow bearings in a manner which permits dsplacement but still is amenable to the transmission of the tension force. The short pins in this case should be easily insertable, and in accordance with another aspect of the invention the pins may be arranged above or below the carrier ring, as are the hollow bearings.

The respective short pins are preferably of spherical bulging contour with a conical or, better, frusto-conical end section. The hollow bearings for these pins should be of a thick wall annulus with a conical entrance. Such a ring shaped hollow bearing is suitable for taking up high tension forces without interfering with the function of the short carrier pin. Also, such a ring is highly economical.

The thermal load on the vessel and the transmission of heat to the fastening structure can be eliminated in that the short carrier pins are provided with a bore which provides several different functions. One of the functions is to receive the regular, vertically arranged tension elements here run through that bore.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed descriptipon of the drawings FIG. 1 illustrates a hot or hot working vessel such as a metallurgical vessel 1, being for example a reactor, a nuclear reactor or another chemical metallurgical reactor or a coal degasing reactor; the vessel 1 can also be a metallurgical intermediate vessel for temporarily storing liquid steel or the like. However in the preferred form of applying the invention the vessel 1 may be a steel converter in which molten iron is converted into steel.

Figure 1:
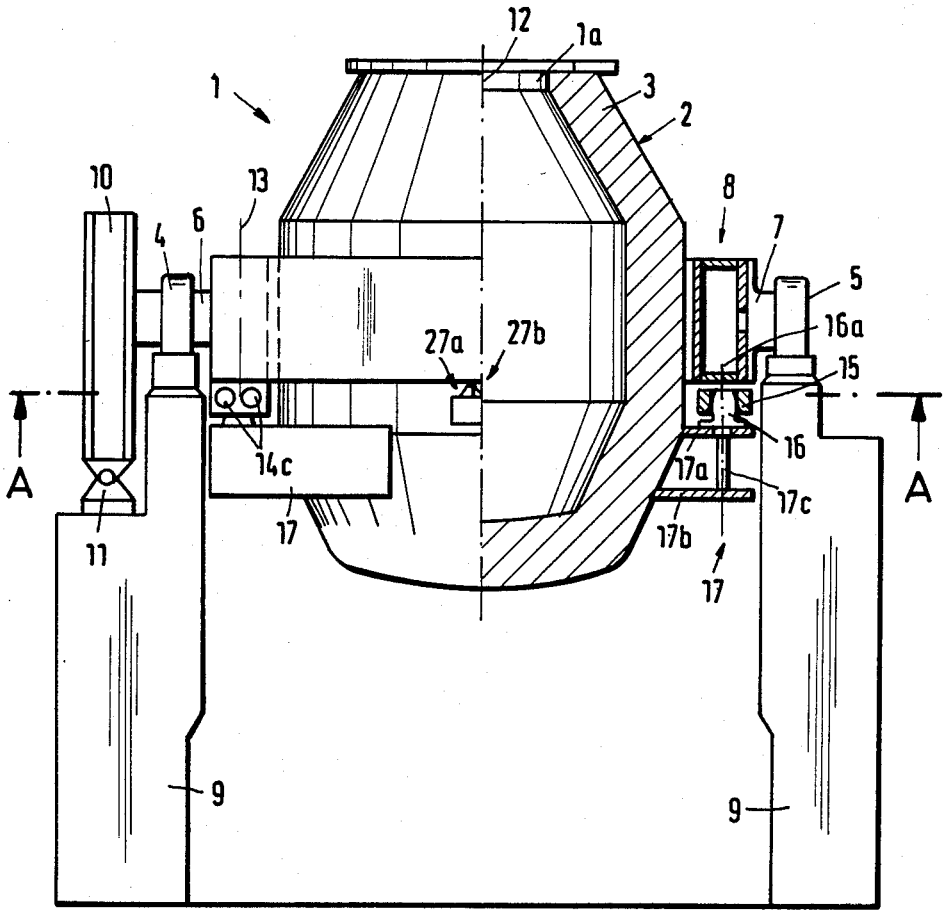
FIG. 1 is a side view shown partially in section of a steel converter with tilt mount in accordance with the first embodiment of the present invention for practicing the best mode thereof.

The vessel 1 has an outer jacket 2 holding and supporting a refractory brick lining 3. Such a steel converter is usually mounted for tilting. Accordingly the figure shows tilt mount bearings 4 and 5 receiving tilt pins 6 and 7 respectively for tilting the vessel on a horizontal axis which runs in the plane of the drawing or parallel there too. The tilting pins 6 and 7 are fastened specifically to a holding frame 8 being constructed as a closed ring 8*a* or annulus. The bearings 4 and 5 are stationary and mount on the foundation or base 9.

The tilt pin 6 is extended through the bearing 4 and carries the tilt drive 10. The drive force for the tilt drive 10 is taken up by torque mount 11. The holding device 8 does not have to be tiltable if in fact the process that runs in the vessel 1 does not require tiltability.

Figure 2:
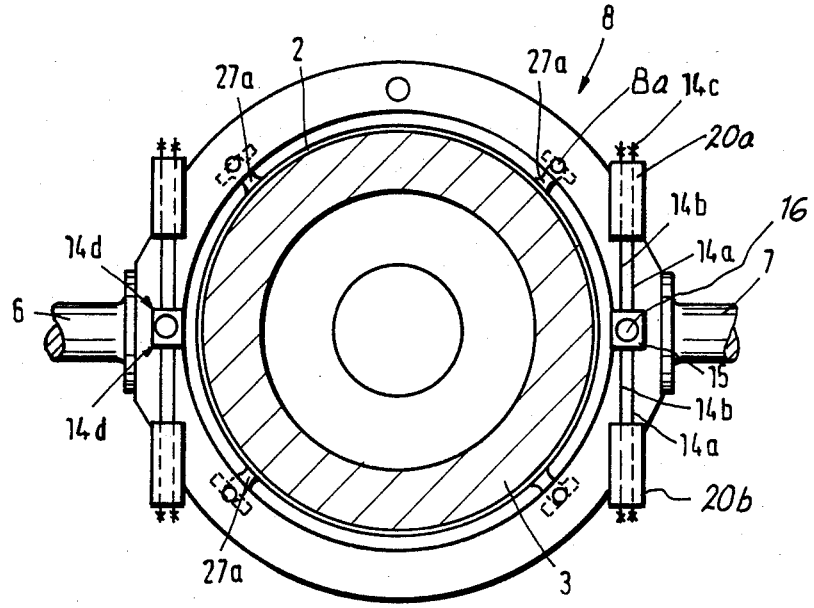
FIG. 2 is a cross section through the vessel as indicated by lines A—A in FIG. 1 as seen from the bottom.

The vessel 1 is in addition held in the direction of the longitudinal center axis 12 by means of bendable pretensioned elements 13. In the so called head mount position i.e. when the opening 1*a* of the converter vessel faces down, the tension or bias for the element 13 is gradually reduced corresponding to the reduction in weight of the vessel as its content pours out. In the transverse position i.e. upon tilting of the vessel when the axis 12 of the vessel assumes a horizontal position (i.e. transverse to the plane of the drawing) transverse fastening-tension elements 14*a* and 14*b* take up the load; they are shown in greater detail in FIGS. 2 and 5. One and each 14*c* of these elements is fastened to the holding ring 8 by means of mounts 20*a* and 20*b* while the respective other ends 14*d* are fastened to a hollow bearing 15. A short carrier pin 16 extends respectively into the hollow bearing 15 which pin 16 is either directly or indirectly connected and secured to the vessel jacket 2. Details of the connection are shown in FIGS. 4 and 5.

Figure 4:
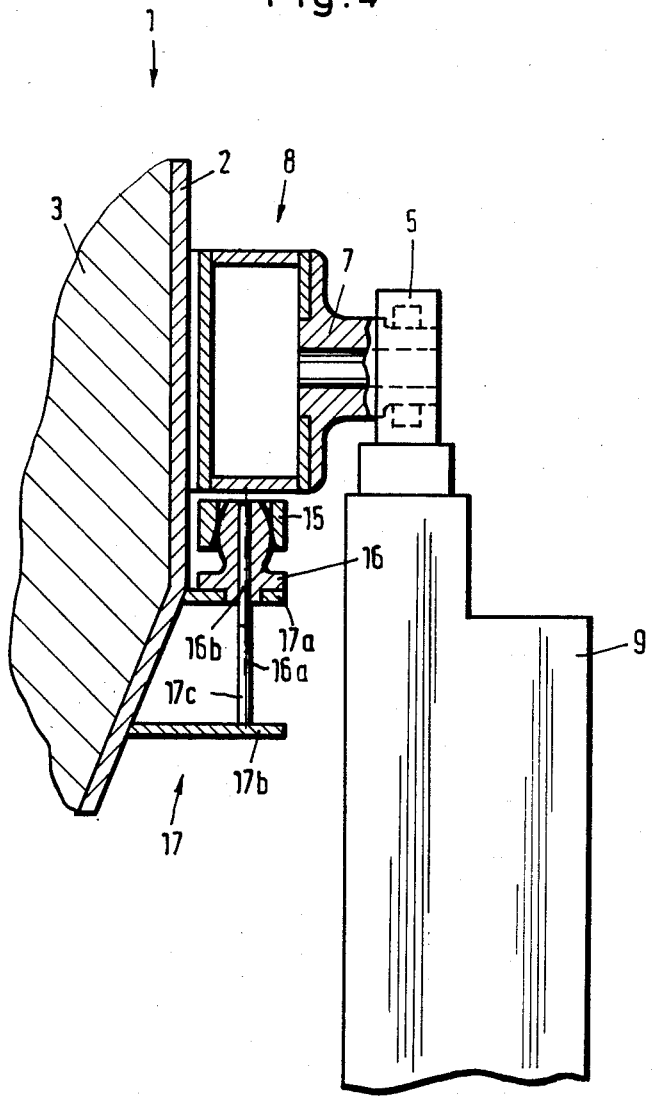
FIG. 4 is an axial vertical cross section through the vessel on an enlarged scale as shown in FIG. 1.

The specific example shown in FIG. 1 exhibits details which can be seen in FIG. 4; short carrier pins 16 are mounted on platforms 17 which are directly affixed to the converter jacket 2. Such a platform arrangement is established by an upper flange plate 17*a* and a lower flange plate 17*b* which are interconnected by several plates or bars 17*c*. The connection is preferably effected through welding. The particular pin such as 16 has barrel shaped configuration and engages surfaces of an opposing curvature in the respective hollow bearing or bushing 15. The respective hollow bearing 15 is affixed to the carrier rin.

Figure 5:
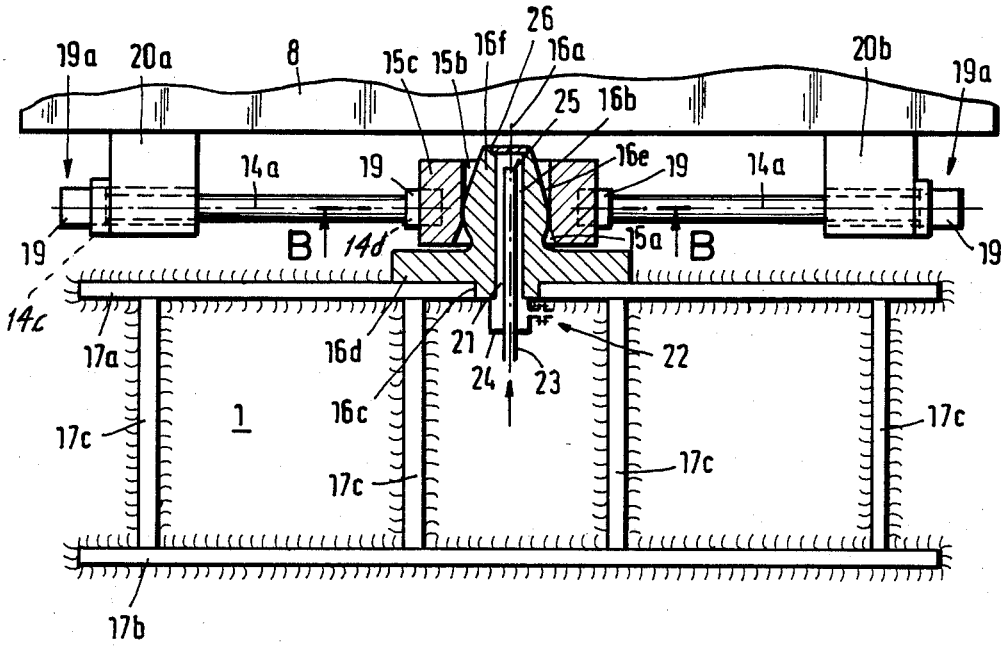
FIG. 5 is a side elevation of certain components for transverse fastening as per FIGS. 1,2 and 4 and illustrated on an enlarged scale.

Certain further details are shown in FIG. 5 including particularly additional functions of the short carrier pin 16. The length of the pin is determined in accordance with the smallest arising bending moment and the obtainable minimal tension in the carrier frame 8 and the vessel wall 2. The pin is particularly shown with a collar 16*c* inserted in the flange plate 17*a* and abutting therewith with a flange 16*d*. Beginning with the flange 16*d* the carrier pin 16 has the bulging portion 16*e* followed in axial direction by conical or frustoconical portion 16*f*. The bulging or spherical section 16*e* as stated is situated in the interior space 15*b* of the bearing 15 which is separated from the exterior by a conical entrance portion 15*a* there being an interior space 16*b* of cylindrical configuration. The bulging portion 16*e* of the pin 16 actually engages that cylindrical portion 16*b* without any slack or tolerances.

Figure 6:
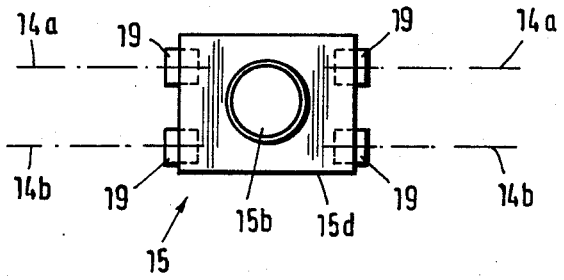
FIG. 6 illustrates a section as indicated by B—B in FIG. 5.

Each hollow bearing member 15 itself is comprised of a thick wall ring 15*c* and it is constructed to have along the outer periphery a quadratic or rectangular shape 15*d* shown in FIG. 6. The transverse fastening and tension elements 14*a* and 14*b* (i.e. their ends 14*d*) are connected thereto by means of clamping heads 19. The other ends 14*c* of these tension elements likewise connected by means of such clamping heads 19*a* to the bearing 20*a* and 20*b* on the side of the holder 8 of the carrier frame whereby in a manner known per se a biasing force is transmitted upon the transverse connection and tension elements 14*a* and 14*b*.

The short pins 16 are provided in the interior with a cooling structure 22. The cooling structure 22 includes further a coolant feeder line 23 and a coolant discharge line 24; both lines to be provided with the appropriate and requisite fittings. At the end of the cooling duct 23 the coolant for example water flows out of an opening 25. The short carrier pin 16 and particularly its interior is closed by means of a cover 26 towards the front while the rear is closed through the housing of the cooling discharge line 24.

The vessel wall 2 is furthermore provided with centering means 27*a* which are fastened to the holder 8 by means of further centering means 27*b* which in turn are connected to that frame 8 and 8*a*. They interengage and are distributed uniformly around the periphery of the carrier 8 in an equidistant fashion. The centering means 27*a* are respectively comprised of projections of the vessel jacket 2 which engage into pairs of lugs on the carrier frame 8. The projections are situated therefore in between the respective lug pair and in the corresponding position in relation to the longitudinal vessel axis 12 so that the vessel 1 is indeed centered in relation to the holder 8.

The vessel 1 in FIGS. 1,2,4,5 and 6 can be exchanged for another one by releasing tension elements 13 which permits placing the vessel 1 for example on a carriage which is not shown. During this assembly procedure the short carrier pins 16 are pulled out of their respective hollow bearing 15 while during instalation the position and relationship is reversed. This placement or displacement operation is permitted because when the axis 16*a* of the short carrier pin 16 extends parallel to the longitudinal axis 12 of the vessel. The transverse fastening-tension elements 14*a* and 14*b* are bendable and they run in a plane transversely to the axis 12. Hence they can yield during the instalation in this assembly procedure. Due to the bulging of pin 16 and hollow bearing 15 their insertion does not have to be precisely coaxial but the bulging contour has a self centering effect.

Figure 3:
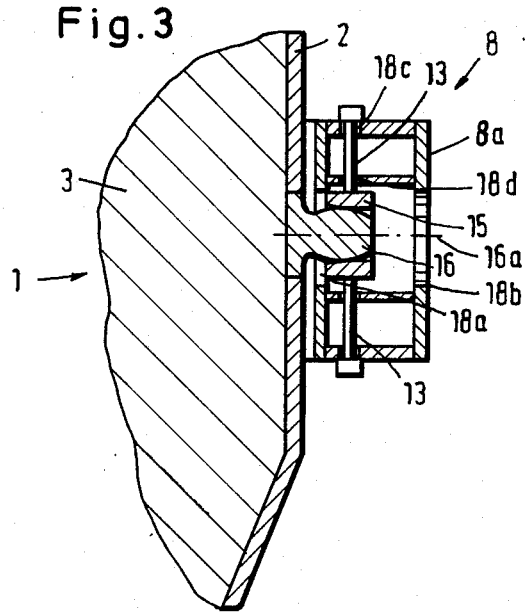
FIG. 3 illustrates a portion of a vessel mount similar in parts of FIG. 1 but as a modification, shown particularly in axial vertical cross section through the vessel with a carrier frame constituting therefore a second example for the preferred embodiment of the present invention.

The modification illustrated in FIG. 3 shows the short carrier pin on one end (there is an analogous arrangement diametrically opposite as far as the vessel 1 is concerned) which pin is welded directly into the jacket 2 of the vessel. The particular hollow bearing 15 is correspondingly turned around by 90 degrees as compared to the arrangement shown in FIGS. 1,4 and 6 and is contained inside the carrier ring 8. There is an opening 18*a* in the carrier ring 8. In this particular example the respective carrier pin 16 functions also as an element of the longitudinal fastening analogous to the function of the earlier described tension element 13. The hollow bearing 15 is situated as stated inside the holder ring 8 and is held by these tension elements 13 therein.

The short carrier pins 16 as well as the hollow bearings 15 are visible from the outside through an opening 18*b* in the holder ring 8 and can, therefore, be inspected as well as made subject to the requisite maintenance. This particular second example is not provided for a rapid exchange of the respective metallurgical vessel 1. However the vessel 1 is supported here as far as function is concerned in that the tension elements 13 provide for a yielding of the hollow bearing 15 as soon as thermal tension arises in wall or jacket 2 tending to displace the local affixation point of the pin 16 vis-a-vis cooler elements in the environment. In this case the pin 16 may in fact assume an oblique position but due to the bulging contour of the facing surfaces of pin 16 and bearing 15 the connection is not subject to binding even in an oblique position and in fact the carrier pin 16 can move back and forth inside hollow bearing 15. Such sliding and/or tilting motion is permitted through the tension element 13 and the enlarged perforation 18*c* and 18*d*. It should be noted that one of the short carrier pins 16, particularly its axis 18*a* should run transversely to the tilting pin access as established by the two tilting pins 6 and 7 so as to permit the transfer of a tilting moment upon the vessel 1.

The invention is not limited to the embodiments described above but all changes and modifications thereof not constituting departures from the spirit and scope of the invention are intended to be included.

We claim:

1. Tilt mount for a metallurgical vessel there being a carrier ring for the vessel having tilt pins mounted and journaled in stationary bearings for tilting the vessel about a horizontal axis, there being means effective in direction of a longitudinal axis of the vessel for mounting the vessel in the carrier ring, further comprising a fastening construction to be effective predominantly when the vessel is tilted to a horizontal position, comprising:

a pair of oppositely positioned hollow bearings;

means for mounting each of these bearings to the carrier ring in locations opposite to each other and including a pair of tension elements for each of the hollow bearings and arranged coaxially to each other and transversely to the longitudinal axis of the vessel, the elements of each pair of tension elements carrying respectively on one end the respective hollow bearing and being with the respective other ends connected to the carrier ring;

a pair of short pins of barrel shaped configuration connected to the vessel and being inserted respectively in the hollow bearings for pivoting on, axes through the pins, these axes and respectively axes through the hollow bearings being horizontally oriented at least when the vessel is tilted into a horizontal position but permitting angular displacement to each other, these axes not coinciding with a tilt axis as defined by said tilt pins.

2. A tilt mount as in claim 1 wherein said hollow bearings and mounted to extend parallel to the longitudinal axis, said short pins being correspondingly mounted to said vessel for insertion in said hollow bearings.

3. A tilt mount as in claim 2, said bearings being mounted to said carrier ring but axially displaced therefrom with respect to the longitudinal axis of the vessel.

4. A tilt mount as in claim 1 said hollow bearings being mounted for a horizontal axis, said pin extending from said vessel in horizontal direction for insertion in said hollow bearings respectively.

5. A tilt mount as in claim 1 wherein each hollow bearing is provided with a conical entrance for easy insertion of the respective short pin.

6. A tilt mount as in claim 1 wherein each of said short pins has a spherical portion and conical portion.

7. A tilt mount as in claim 1 wherein each of said short pins is provided with a hollow interior for receiving a coolant flow.

8. A tilt mount for a metallurgical vessel there being a carrier ring for the vessel having tilt pins mounted thereto the pins being journaled in stationary bearings for tilting the vessel about a horizontal axis, there being means effective in direction of the longitudinal axis of the vessel to mount the vessel in teh carrier ring, a device for providing support of the vessel predominantly when the vessel is tilted into horizontal position comprising:

a pair of oppositely positioned hollow bearings oriented with axes parallel to the longitudinal axis of the vesses;

a pair of tension elements for each of the hollow bearings and arranged coaxially to each other and transversely to the longitudinal axis of the vessel, the elementš of each pair of tension elements carrying respectively on one end the respective hollow bearing and being with the respective other ends connected to the carrier ring; and a pair of short pins mounted to the vessel and being inserted in said hollow bearings.

9. A tilt mount for a metallurgical vessel there being a carrier ring for the vessel having tilt pins mounted in stationary bearings for tilting the vessel about a horizontal axis there being means effective in direction of a longitudinal axis of the vessel to mount the vessel in the carrier ring, a construction for taking up predominantly a load of the vessel when the vessel is tilted into the horizontal position comprising:

a pair of oppositely positioned hollow bearings with horizontal axes;

a pair of tension elements for each of the hollow bearings and arranged coaxially to each other and transversely to the longitudinal axis of the vessel, the elements of each pair of tension elements carrying respectively on one hand the respective hollow bearing and being with the respective other ends connected to the carrier ring mounting these bearings therewith in said carrier ring;

and a pair of short pins extedning from the vessel in horizontal direction and being inserted in said hollow bearings in coaxial relationship, the axes not coinciding with said horizontal axis of tilting as defined by the tilt pins.

* * * * *